US007372476B2

(12) United States Patent
Haimberger et al.

(10) Patent No.: US 7,372,476 B2
(45) Date of Patent: May 13, 2008

(54) THERMAL PRINTING DEVICE, METHOD FOR PRINTING AN IMAGE USING SAID PRINTING DEVICE AND SYSTEM FOR PRINTING AN IMAGE

(75) Inventors: Walter P. Haimberger, Topsfield, MA (US); Dana F. Schuh, Windham, NH (US)

(73) Assignee: Polaroid Corporation, Concord, MA (US)

( * ) Notice: Subject to any disclaimer, the term of this patent is extended or adjusted under 35 U.S.C. 154(b) by 226 days.

(21) Appl. No.: 11/280,037

(22) Filed: Nov. 16, 2005

(65) Prior Publication Data

US 2006/0103715 A1 May 18, 2006

Related U.S. Application Data

(60) Provisional application No. 60/627,909, filed on Nov. 16, 2004.

(51) Int. Cl.
*B41J 2/32* (2006.01)

(52) U.S. Cl. ..... 347/171; 347/218

(58) Field of Classification Search ..... 347/215–219, 347/171; 400/642, 645, 645.3, 645.4
See application file for complete search history.

(56) References Cited

U.S. PATENT DOCUMENTS

| | | | | |
|---|---|---|---|---|
| 4,212,552 | A | 7/1980 | Bemis et al. | 400/249 |
| 4,811,036 | A | 3/1989 | Gaskill et al. | 346/76 PH |
| 4,857,941 | A | 8/1989 | Kaida | 346/76 PH |
| 4,932,798 | A | 6/1990 | Kardinal et al. | 400/120 |
| 4,940,993 | A | 7/1990 | Sato | 346/76 PH |
| 4,956,251 | A | 9/1990 | Washizu et al. | 430/138 |
| 4,962,386 | A | 10/1990 | Hakkaku et al. | 346/1.1 |
| 5,095,316 | A | 3/1992 | Hakkaku | 346/1.1 |
| 5,101,222 | A | 3/1992 | Hakkaku | 346/76 PH |
| 5,284,816 | A | 2/1994 | Stephenson | 503/227 |
| 5,486,057 | A | 1/1996 | Skinner et al. | 400/120.02 |
| 5,550,572 | A | 8/1996 | Chang et al. | 347/171 |
| 5,558,449 | A | 9/1996 | Morgavi | 400/188 |
| 5,600,362 | A | 2/1997 | Morgavi et al. | 347/218 |
| 5,675,369 | A | 10/1997 | Gaskill | 347/171 |
| 5,677,722 | A | 10/1997 | Park | 347/218 |
| 5,973,711 | A | 10/1999 | Schartner et al. | 347/173 |
| 6,046,756 | A | 4/2000 | Iga et al. | 347/173 |
| 6,296,405 | B1 | 10/2001 | Brewington et al. | 400/188 |

(Continued)

FOREIGN PATENT DOCUMENTS

| | | |
|---|---|---|
| EP | 0 517 285 A1 | 12/1992 |

(Continued)

*Primary Examiner*—Huan Tran

(57) ABSTRACT

A printing device that includes a platen for supporting an imaging member during a printing operation and at least one print head subassembly for direct thermal printing on the imaging member. The print head subassembly is configured to be movable independently of the platen for printing on a first surface of the imaging member in a first transport path and on a second surface of the imaging member in a second transport path. The printing device also includes an element movable with said print head subassembly for ensuring that the wrap of the imaging member around the platen is substantially symmetrical about the print line such that the thermal heating elements of the thermal print head are substantially parallel to the surface of the imaging member when printing on each side of the imaging member.

8 Claims, 5 Drawing Sheets

U.S. PATENT DOCUMENTS

| | | | | |
|---|---|---|---|---|
| 6,601,952 | B2 | 8/2003 | Sugioka et al. | 347/104 |
| 6,801,233 | B2 | 10/2004 | Bhatt et al. | 347/175 |
| 7,198,419 | B2 * | 4/2007 | Lee | 400/120.16 |
| 2001/0021331 | A1 | 9/2001 | Brewington et al. | 400/188 |

FOREIGN PATENT DOCUMENTS

| | | | | |
|---|---|---|---|---|
| EP | 0 785 079 | B1 | 6/2000 | |
| JP | 59-020688 | | 2/1984 | |
| JP | 59-150762 | * | 8/1984 | 347/216 |
| JP | 61094780 | | 5/1986 | |
| JP | 05-131702 | | 5/1993 | |

* cited by examiner

THERMAL PRINTING DEVICE, METHOD FOR PRINTING AN IMAGE USING SAID PRINTING DEVICE AND SYSTEM FOR PRINTING AN IMAGE

REFERENCE TO RELATED APPLICATION

This application claims the benefit of provisional application Ser. No. 60/627,909, filed Nov. 16, 2004.

BACKGROUND OF THE INVENTION

1. Field of the Invention

The present invention relates generally to thermal printing devices. More specifically, the present invention relates to a thermal printing device, a method for printing a multicolored image using the printing device and a system for printing multicolored images.

2. Description of Related Art

Various conventional printing devices include a printing head that is capable of transferring a colorant to a substrate. Several different techniques may be used for the transfer of colorant, including ink jet, electrostatic toner transfer, and thermal transfer. Printing devices using these techniques can print a single, or more than one, color, and may print onto individual or continuous sheets that may be opaque or transparent.

Users of printing devices typically demand printing of photographic quality so that they can, for example, print digital images captured from digital cameras. The desire for photographic quality, full-color images has forced conventional, colorant-transfer printing technologies to evolve to their limits. Such technologies have, in some cases, proved to be less than satisfactory for photographic printing.

Direct thermal printing provides an entirely different method for forming images on an imaging material, which may be in the form of an individual sheet of a specific size, e.g., 4×6 inches or a continuous sheet. Typically, the imaging material includes a substrate, or carrier, and a plurality of color-forming layers can be arranged on one side of the substrate or one or more color-forming layers can be arranged on each side of the substrate. A direct thermal printing device includes no ink, toner, or transfer ribbon, but simply a printing head for heating the imaging sheet itself. The imaging material for use in direct thermal printing contains at least one dye or dye precursor that changes color when heated. Examples of direct thermal printing systems are disclosed in, for example, U.S. Pat. No. 6,801,233 B2 assigned to the assignee of the instant application.

Imaging materials for direct thermal printing devices that are intended to produce multicolored images may be transparent, and may include at least one color-forming layer on each surface. Each color-forming layer on one side of the substrate forms an image in at least one color, while each color-forming layer on the other side of the substrate forms an image in at least another color. Images are formed by heating each side of the imaging material with a thermal head or other heating device, which can apply heat in an imagewise pattern. The images formed on each side of the transparent substrate are viewed together from one side of the imaging material to present to the viewer a composite, multicolored image. In conventional printing onto an opaque imaging sheet, on the other hand, there is no need for the images on each side of the sheet to be the same size as each other, or in registration.

Several methods for printing on both surfaces of a direct thermal imaging material have been proposed. For example, U.S. Pat. No. 4,962,386 discloses a printing device with an extremely complex mechanism for rotating the substrate such that both surfaces can be exposed to a print head sequentially. In U.S. Pat. No. 6,601,952 a method is disclosed for rotating an entire recording unit to print on the second surface of an imaging material. Another method for imaging both surfaces of a direct thermal imaging material employs two print heads, one of which heats one side of the imaging material, while the other heats the opposite side. Each of these prior art methods for printing involves complex arrangements that may be high in cost or difficult to maintain.

Accordingly, there is a need for a thermal printer with a simplified construction that can overcome the deficiencies of the prior art printers.

BRIEF SUMMARY OF THE INVENTION

An object of the present invention is to provide a novel thermal printing device.

Another object of the invention is to provide a thermal printing device that is capable of heating opposite sides of a direct thermal imaging material, or member, successively in each of two separate printing passes, by independently moving a print head subassembly of the printer relative to a platen.

Another object of the present invention is to provide a print head subassembly within a thermal printing device that is configured to rotate about a platen such that heating of both sides of an imaging member can be performed.

Still another object of the invention is to provide a print head subassembly within a thermal printing device that is configured to print on both sides of an imaging member wherein the thermal heating elements of the thermal print head are substantially parallel to the surface of the imaging member when printing on each side of the imaging member.

Yet another object is to provide such a print head subassembly wherein the imaging member has a substantially symmetrical wrap around a segment of the platen which extends on both sides of the print line when the print head is printing on each side of the imaging member.

BRIEF DESCRIPTION OF THE DRAWINGS

Additional objects, features, and advantages of the present invention will become apparent from the following detailed description of the preferred embodiments of the invention in conjunction with the accompanying drawings where like reference numerals indicate like features, in which.

DETAILED DESCRIPTION OF PREFERRED EMBODIMENTS

Figure 1:
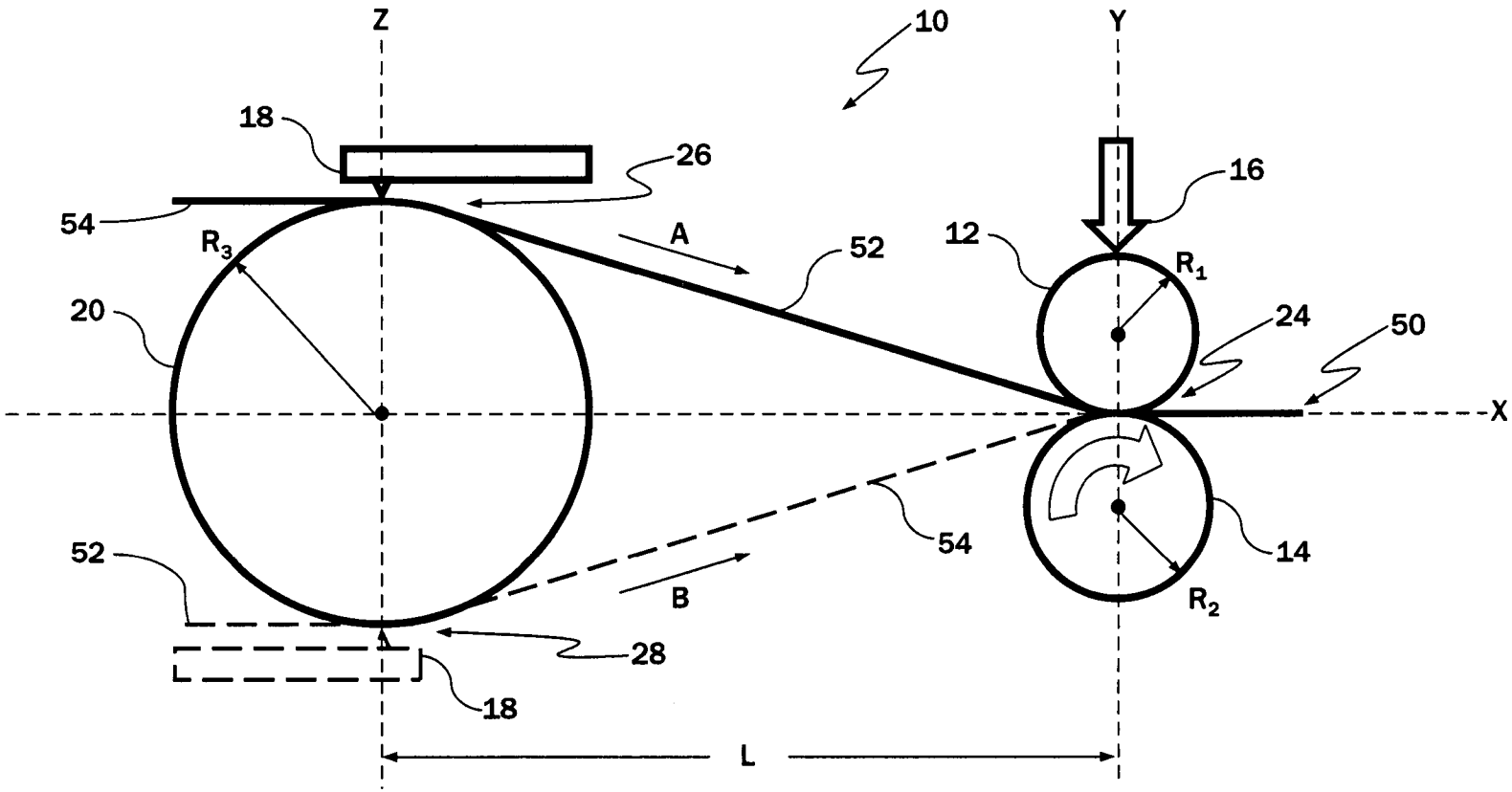
FIG. 1 is a schematic diagram of a thermal printing device with a rotating print head subassembly.

Referring now to FIG. 1 there is seen a schematic diagram of a thermal printing device 10 with a rotating print head subassembly 18. The thermal printing device 10 includes a first roller 12 and a second roller 14 for driving an imaging member 50 though the thermal printing device 10. Together, roller 12 and roller 14 form a driving nip 24. At least one of the first roller 12 and second roller 14 is rotationally driven to move the imaging member 50 through the driving nip 24. The rotationally driven roller is also referred to hereinafter as the driving roller. In the embodiment shown in FIG. 1, the driving roller is roller 14 and roller 12 is a pressure roller biased by an optional spring 16 for ensuring that the imaging member 50 is generally in contact with both the pressure roller 12 and the driving roller 14.

Although the pressure roller 12 and the driving roller 14 are shown as single rollers, it should be understood that there may be advantages to providing a plurality of pressure and/or driving rollers instead of a single pressure or driving roller. Additionally, in some embodiments, the pressure roller 12 and driving roller 14 may extend from one edge of the imaging member 50 to the other, although this is not required. For example, in one embodiment, the driving roller 14 could be a single roller that extends across the imaging member 50 and the pressure roller 12 could be a plurality of rollers on a single shaft which would create a plurality of driving nips 24. In other, more general embodiments, the rollers described above may be any suitable device for driving the imaging member. In such a case, any type of driving and pressure elements may be used including rollers, belts, and the like.

The imaging sheet 50 may be any type of thermal imaging material. In the embodiment shown in FIG. 1, the imaging member includes a transparent substrate carrying at least one color-forming layer on a top surface 52 and at least one color-forming layer on a bottom surface 54 of the member. Further, it may be preferred in some embodiments to have two color-forming layers on one of the surfaces of the imaging member 50 such that a full color image may be obtained. Specifically, for the purpose of discussion, imaging member 50 may have yellow and magenta color-forming layers on surface 52 and a cyan color-forming layer on surface 54 of a transparent substrate. In this manner, it is possible to create, on imaging member 50, a full color image.

The printing device 10 also includes a platen 20 for supporting the imaging member 50 while a print head subassembly 18 is engaging the imaging member 50. The print head subassembly 18 includes a print head and may, in some embodiments, also include additional elements necessary for printing on imaging materials. For example, the print head subassembly 18 may also include a controller, a heat dissipation device, etc. As shown in FIG. 1, the imaging member 50 may take one of two paths, either path A or path B. Specifically, the imaging member 50 may initially take path A and means, such as an additional roller or deflector, may be provided for guiding the member 50 in the direction indicated by A. Once the member 50 is engaged by the nip 26 formed by the platen 20 and the print head subassembly 18 located in the first, or upper, position, the print head subassembly 18, based on received information, can process the yellow and magenta color-forming layers located on surface 52 of the member, preferably in a single pass. Once that is complete, the print head subassembly 18 is rotated to a second position, shown under the platen 20, in FIG. 1. The imaging member 50 is then guided via path B through a nip 28 formed by the platen 20 and the print head subassembly 18 at the bottom of the platen 20. As can be seen from FIG. 1, when the imaging member 50 is in this position, the print head subassembly 18 can now process surface 54 of the imaging member 50 that contains the cyan color-forming layer.

In the embodiment shown in FIG. 1, the imaging sheet 50 is guided past the pressure roller 12 and driving roller 14 in the direction shown by arrows A and B (i.e., it is pulled away from the nips 26, 28) during the printing operation. However, as would be understood by a person skilled in the art, the imaging member can also be transported by means other those illustrated.

As seen in FIG. 1, a rotational axis of the platen 20 is aligned with the driving nip 24 formed by pressure roller 12 and driving roller 14 (indicated by X) to produce a symmetric geometry between the first path A and the second path B. Additionally, as shown in FIG. 1 (and also in subsequent Figs.) a substantially vertical axis Z that passes through the rotational axis of the platen, and a substantially vertical axis Y that passes through the rotational axes of the pressure roller 12 and driving roller 14 are both substantially perpendicular to axis X. Such symmetry may be beneficial in particular embodiments of the present invention, but is not required and is illustrated for the purpose of discussion.

In the embodiment of FIG. 1, since only the print head subassembly 18 is rotated around the platen 20 to one of the two positions, as shown, the number of moving parts is decreased from, for example, rotating both the print head subassembly 18 and platen 20 as is done in some other conventional printing devices. Additionally, since the imaging member does not have to be inverted during the imaging process and a print head on either side is not required, the complexity of the printing device is decreased as compared to some conventional printing devices. As would be understood by a person of ordinary skill in the art, the thermal printing arrangement 10 shown in FIG. 1 can be used to make a compact device.

In some embodiments, the print head subassembly 18 may be rotated by 180 degrees and in general, the rotation of the print head subassembly 18 is greater than 90 degrees. Even more generally, the print head subassembly 18 is moved from a first to a second position.

A thermal printing device 10 such as that illustrated in FIG. 1, in which the print head subassembly 18 is moved from one position to another in order to print on both sides of an imaging member 50 in two separate printing passes, must be designed so that the transport of the imaging member is substantially the same for both printing passes. It is also necessary that the alignment of the thermal print head subassembly 18 with respect to the imaging member 50 be optimal for high-quality printing during each printing pass.

Figure 2:
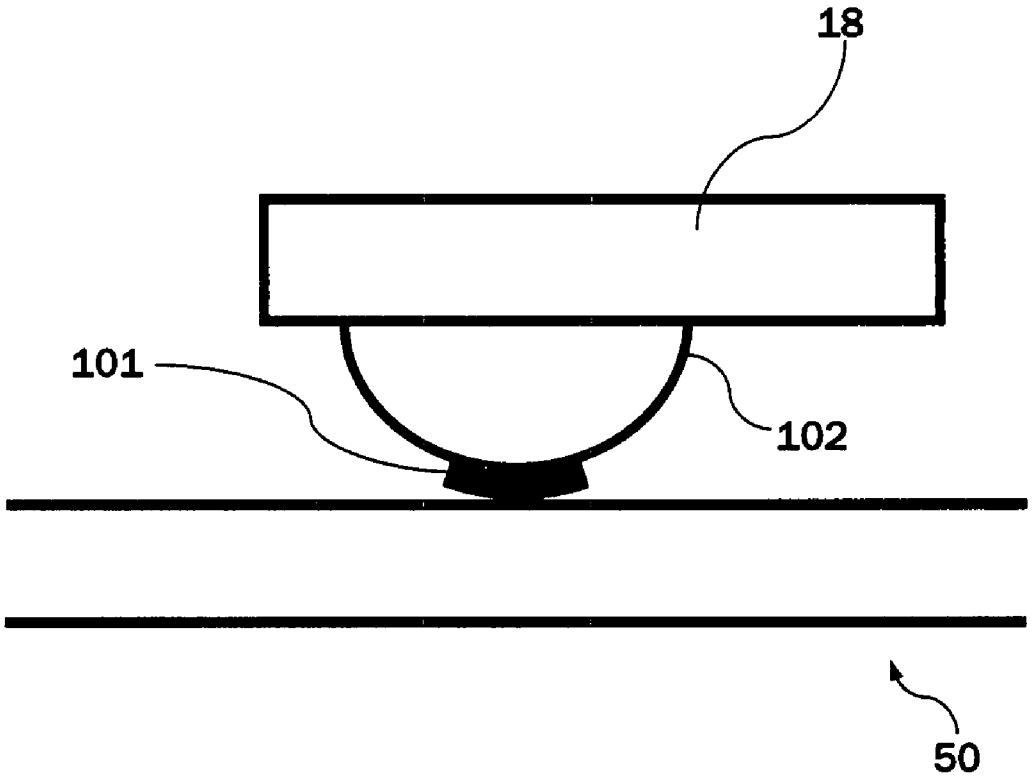
FIG. 2 is a schematic diagram of a print head.

FIG. 2 is a schematic illustration of a cross-section through a typical thermal print head subassembly 18. The print head comprises a line of heating elements 101, one of which is shown, that extends perpendicular to the plane of the drawing. This line of heating elements is hereinafter referred to as the print line. The heating elements that make up the print line lie substantially, but not necessarily exactly, along a straight line. Each heating element is independently electrically addressable and makes contact with the surface of the imaging member 50. Passage of electrical current through the heating elements generates heat, which is transferred through thermal conduction into the imaging member 50. Effective thermal conduction takes place when the heating elements are in good contact with the surface of the imaging member 50. In a typical thermal print head, the print line may be disposed on a raised glaze 102 and glaze 102 may be curved. The actual dimensions and shape of the glaze vary from print head to print head, as does the location of the print line with respect to the glaze.

Figure 3:
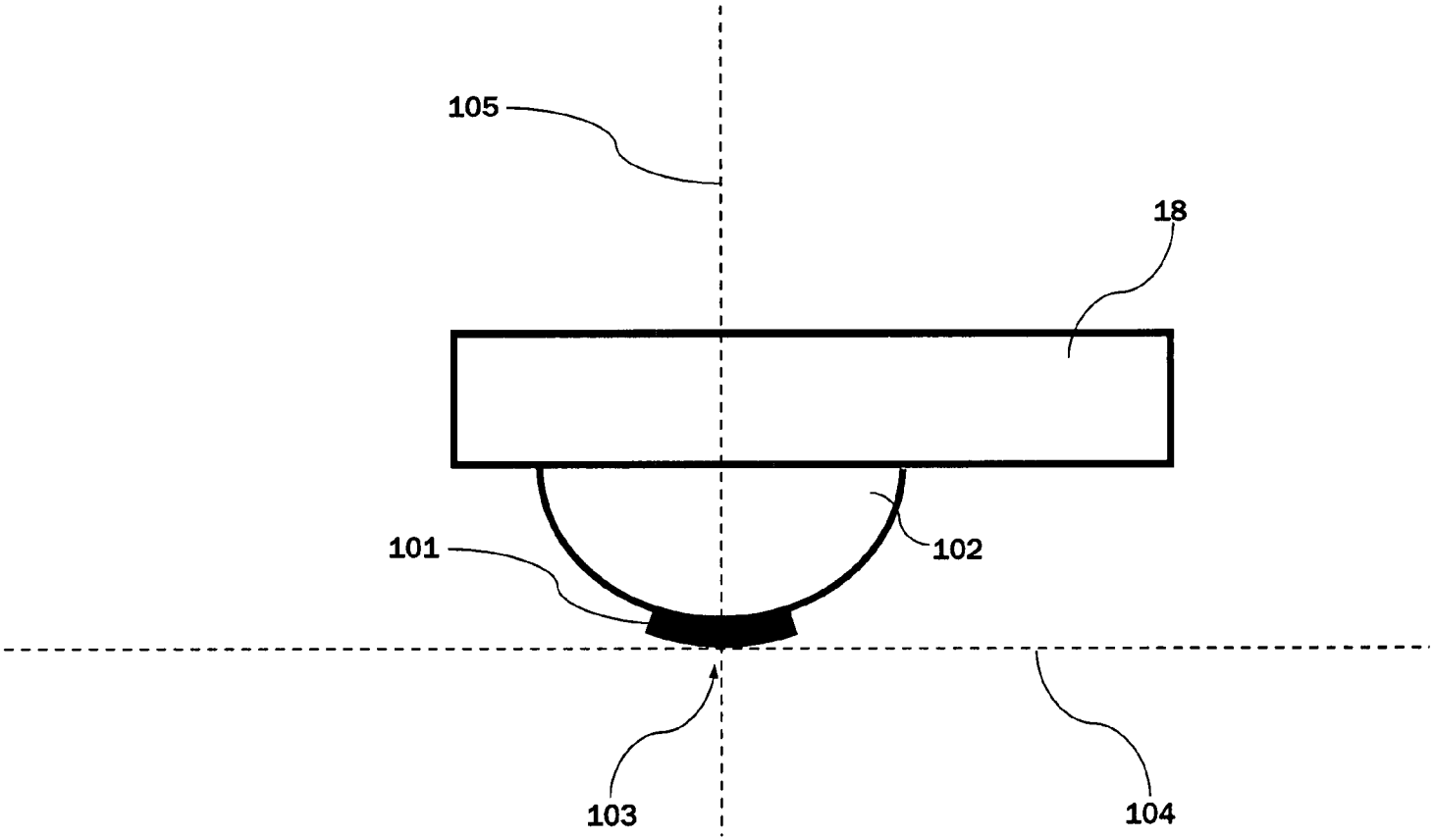
FIG. 3 is a schematic diagram of the print head showing more particularly the geometry of the location with respect to the glaze on which the print line is located.

FIG. 3 is a magnified, cross-sectional view of a print head 18. In FIG. 3 the heating element 101 illustrated is shown as curved to conform to the glaze 102 geometry, although this is only for the purpose of illustration, and the heating elements may be planar or curved. A line 103, that extends perpendicular to the plane of the page, joins the centers of the heating elements, and plane 104 is tangent to the surface of the print line at line 103. Plane 105 is perpendicular to plane 104 and passes through line 103.

Figure 4:
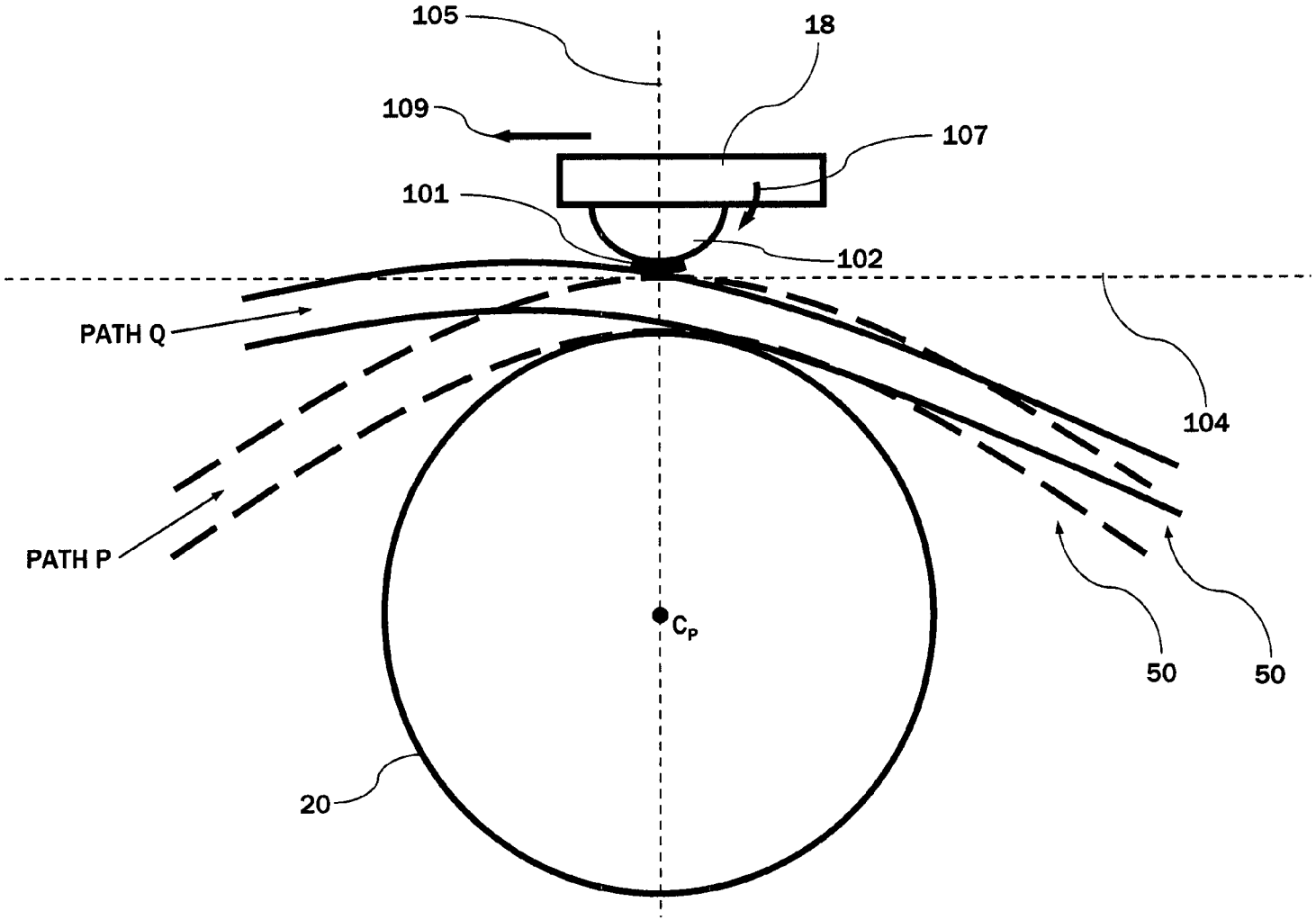
FIG. 4 is a schematic diagram of an imaging material contacted on one surface by a thermal print head and wrapped symmetrically or unsymmetrically around a platen in contact with the opposing surface, illustrating how the wrap of the imaging material around the platen affects the print head alignment.

FIG. 4 shows imaging member 50, wrapped around platen 20, in contact with thermal print head assembly 18. The print line is aligned such that plane 105 that is perpendicular to the print line surface and passes through centerline 103 (FIG. 3) also passes through the rotation axis Cp of the platen roller 20. This alignment of the print line with respect to the platen is referred to throughout the application as "dead center". In this position, plane 104 that is tangent to the print line surface at centerline 103 is parallel to a plane tangent to the platen roller surface and perpendicular to plane 105. As described above, the thermal contact between the print line and imaging member 50 must be optimized to ensure efficient imaging. This will be the case when imaging member 50 is substantially tangent to the surface of the print line at the centerline 103, i.e., when imaging member 50 is in contact with line 103 and substantially parallel to plane 104 at that line of contact. FIG. 4 shows two paths of travel for the imaging member: path P, in which imaging member 50 is substantially symmetrically wrapped around a segment of platen 20, and path Q, in which the wrap of imaging member 50 around platen 20 is not symmetrical. In path P, imaging member 50 is in contact with line 103 and parallel to plane 104 at that line of contact. However, in path Q, although imaging member 50 may be in contact with heating elements 101, it is not parallel to plane 104 at that line of contact, and is not in optimal thermal contact with the print line. As can be seen from FIG. 4, dead center print line alignment is only appropriate in path P when the imaging member 50 is substantially symmetrically wrapped around a segment of platen 20 with respect to the plane 105 defined by the platen roller axis Cp and the center line 103. It is also apparent from FIG. 4 that optimal alignment in path Q would be attainable if the print head 18 were rotated slightly in the direction of arrow 107, or else translated in the direction of arrow 109, out of the dead center position.

In thermal printing devices 10 such as that shown in FIG. 1, the driving nip 24 creates a tension in the imaging member 50 on one side of the printing nip, 26 or 28 but typically no such tension is present in the imaging member 50 on the opposite side of the printing nip. The forces exerted on the imaging member 50 are therefore not symmetrical. The unsymmetrical forces cause the imaging member 50 to wrap unsymmetrically around the platen 20. Therefore, in such thermal printing devices, paths analogous to path Q of FIG. 4 are typically followed by the imaging member, necessitating an alignment of the print line with the platen that is not dead center as defined above, unless steps are taken to make the wrap of the imaging member around the platen more symmetrical about centerline 103 (FIG. 3).

Figure 5:
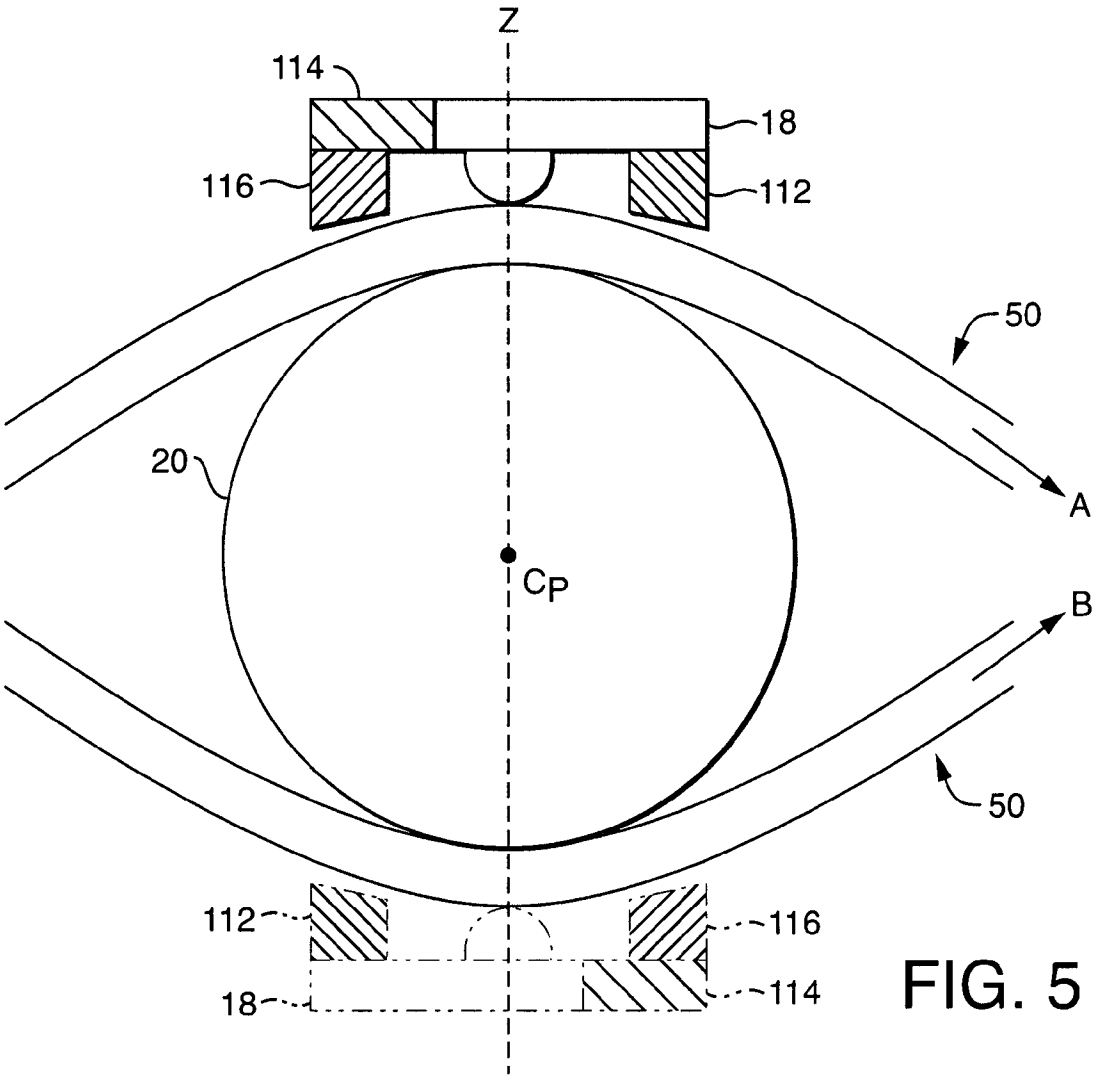
FIG. 5 is a schematic diagram of a thermal printing device with a rotating print head subassembly and guiding means for maintaining a substantially symmetrical wrap of an imaging material around a segment of the platen with respect to the line of contact of the imaging member with the print line.

FIG. 5 is a schematic diagram of a thermal printing device 10 according to the invention. The printing device 10 includes a rotating print head subassembly 18, in which means are affixed to the print head subassembly to ensure that the wrap of the imaging member 50 around a segment of the platen 20 is substantially symmetrical about the print line such that the thermal heating elements of the thermal print head are substantially parallel to the surface of the imaging member when printing on each side of the imaging member.

In FIG. 5 a guide 116, shown as attached to the print head subassembly 18 though connecting member 114, causes the imaging member 50 to be constrained on the opposite side of the printing nip from the driving roller (not specifically shown, but located so as to transport the imaging member 50 in the direction of arrow A). The constraint imposed by guide 116 causes the imaging member to wrap substantially symmetrically about a segment of the platen 20 while being printed in path A. In this configuration, optimal alignment of the print line can be at the dead center position as defined above. Guide 112, also shown as attached to print head subassembly 18, does not necessarily constrain the wrap of the imaging member while printing in path A (although, in some embodiments of the present invention, it may do so). The principal function of guide 112 is to constrain the wrap of imaging member 50 around a segment of platen 20 when the print head subassembly is repositioned for printing in path B, as shown in FIG. 5. Guide 112 performs substantially the same function for printing in path B as is performed by guide 116 for printing in path A. As a result, the alignment of the print line can be dead center for printing in path B. Although the repositioning of the print head subassembly 18 from its position for printing in path A to its position for printing in path B is shown as an approximately 180 degree rotation about the platen roller axis Cp in FIG. 5, this does not have to be the case. The repositioning is not required to be through a rotation, and if a rotation, is not necessarily about the platen roller axis nor necessarily through approximately 180 degrees. The guiding means 112 and 116 may be any means for guiding the imaging member (for example, rollers or baffles) and may make contact with imaging member 50 either across its whole width or only across portions of its width. Likewise, guiding means 112 and 116 may be physically attached to print head subassembly 18, as shown, or may be independently positioned for guiding the imaging member 50 in paths A and B.

The embodiments described herein are intended to be illustrative of this invention. As will be recognized by those of ordinary skill in the art, various modifications and changes can be made to these embodiments and such variations and modifications would remain within the spirit and scope of the invention defined in the appended claims and their equivalents. Additional advantages and modifications will readily occur to those of ordinary skill in the art. Therefore, the invention in its broader aspects is not limited to the specific details and representative embodiments shown and described herein.

What is claimed is:

1. A printing device comprising:

a platen for supporting an imaging member during a printing operation; and at least one print head subassembly comprising at least one thermal print head for direct thermal printing on said imaging member, said at least one print head subassembly being configured to be movable independently of said platen for printing on a first surface of said imaging member in a first transport path of said imaging member and on a second surface of said imaging member in a second transport path of said imaging member; and means movable with said print head subassembly for providing a substantially symmetrical wrap of said imaging member around a segment of said platen extending on both sides of the location where said thermal print head contacts said imaging member when printing on said first and said second surfaces of said imaging member.

2. The printing device of claim 1 wherein said means movable with said print head subassembly comprises a guide element.

3. The printing device of claim 2 wherein said guide element includes a roller.

4. The printing device of claim 1 wherein said means movable with said subassembly is positioned to contact the imaging member across the entire width of the imaging member.

5. The printing device of claim 1 wherein said means movable with said subassembly is attached to said subassembly.

6. The printing device of claim 1 wherein said means movable with said subassembly is independent of said subassembly.

7. A thermal printing method comprising (a) providing a direct thermal imaging member having first and second opposed surfaces;

(b) forming an image in said imaging member with a printing device as defined in claim 1 by the steps:

(b)(1) applying thermal energy to said first surface in an imagewise pattern; and (b)(2) applying thermal energy to said second surface in an imagewise pattern whereby an image is formed in said imaging member.

8. The printing method of claim 7 wherein said means movable with said print head subassembly comprises a guide element.

* * * * *